United States Patent [19]

Scott

[11] 4,382,719

[45] May 10, 1983

[54] METHODS OF REINFORCING AND STABILIZING AN EARTH STRUCTURE, AND A STABILIZER SET THEREFOR

[76] Inventor: James J. Scott, Lecoma Star Rte., Rolla, Mo. 65401

[21] Appl. No.: 248,056

[22] Filed: Mar. 27, 1981

[51] Int. Cl.[3] ..... E21F 21/00

[52] U.S. Cl. ..... 405/259; 411/355

[58] Field of Search ..... 405/259; 411/355, 439; 404/15, 16

[56] References Cited

U.S. PATENT DOCUMENTS

| | | | |
|---|---|---|---|
| Re. 30,256 | 4/1980 | Scott | 405/259 |
| 2,018,260 | 10/1935 | Henderson | 404/15 |
| 2,395,689 | 2/1946 | Sembower | 405/259 X |
| 2,570,003 | 10/1951 | Palmer | 405/259 X |
| 2,664,065 | 12/1953 | Thompson | 404/15 X |
| 3,922,867 | 12/1975 | Scott | 405/259 X |
| 4,012,913 | 3/1977 | Scott | 405/259 X |
| 4,126,004 | 11/1978 | Lindeboom | 405/259 |
| 4,289,426 | 9/1981 | Chaiko | 405/259 |
| 4,293,243 | 10/1981 | Graybeal | 405/259 |
| 4,334,804 | 6/1982 | Lindeboom | 405/259 |

*Primary Examiner*—Nile C. Byers, Jr.
*Attorney, Agent, or Firm*—B. J. Murphy

[57] ABSTRACT

According to an embodiment thereof, the stabilizer set comprises a first, basic, friction rock stabilizer for insertion into a bore formed within an earth structure, and a second, supplementary, friction rock stabilizer, having an annulus for supporting a roof plate, for insertion into the first stabilizer for frictional engagement therewith to provide (a) yieldability of the roof plate and/or (b) reinforcement of the first stabilizer. The methods of the invention, then, comprise inserting a supplementary friction rock stabilizer into a first-inserted friction rock stabilizer in order to reinforce the first, or to provide a necessary yieldability when it is anticipated that the roof plate may become unduly loaded.

15 Claims, 4 Drawing Figures

Figure 1:
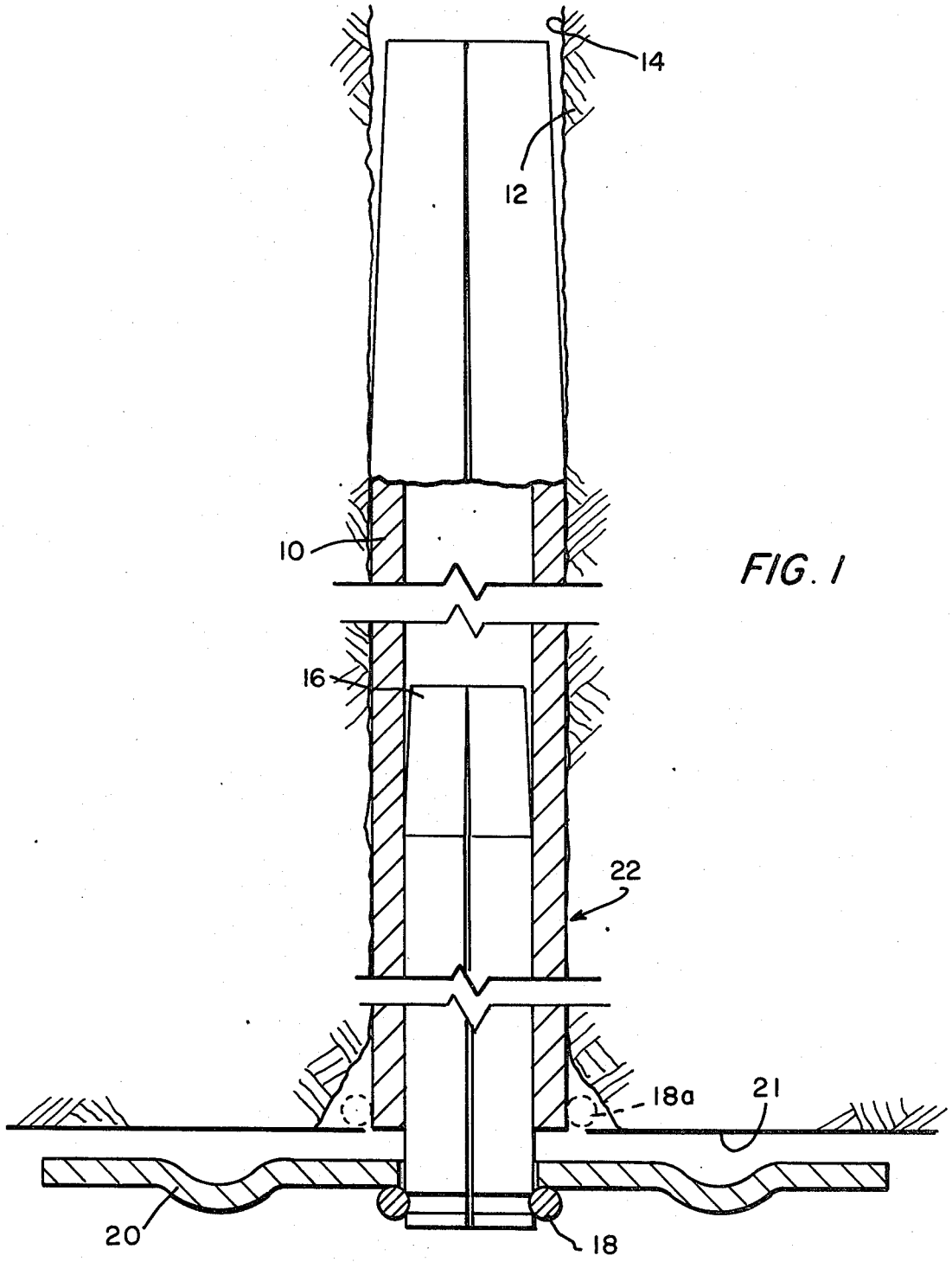

METHODS OF REINFORCING AND STABILIZING AN EARTH STRUCTURE, AND A STABILIZER SET THEREFOR

This invention pertains to friction rock stabilizers and to methods of stabilizing an earth structure and, in a particular, to a novel set of friction rock stabilizers for earth stabilization or reinforcement and to methods for such reinforcement and stabilization.

Friction rock stabilizers are well known in the prior art, particularly from U.S. Pat. No. Re. 30,256, granted to James J. Scott, on Apr. 8, 1980, for "Friction Rock Stabilizers", and comprise elongate, substantially hollow, metal bodies which, typically, have a slot extending throughout the length thereof. Such stabilizers are forced into undersized bores in the earth for stabilization of the earth. They have an annulus on the trailing end which supports a plate against the roof or wall of the subterranean structure in which the stabilizer-receiving bores are formed.

The friction rock stabilizers, according to the aforementioned patent, are remarkable improvements over point anchor roof bolts in that they are axially yieldable without losing their earth stabilizing capability. Thus, if the plate, which they carry against the roof or the earth structure, becomes unduly loaded, the entire stabilizer can retract or withdraw, incrementally, from the hole, and again set up frictional and stabilizing engagement with the bore in a slidably, axially displaced position. It will occur, however, that, upon a stabilizer having been set in an earth structure bore for some period of time, it will be deformed along the length thereof; this occurs due to a shifting of planes of the geologic structure. When this has happened, the stabilizer is, for all intents and purposes, *locked* in the structure. Then, if the roof plate becomes unduly loaded, the annulus at the base or end of the stabilizer (which supports the roof plate) can be broken away or sheared off, and th plate will fall from the roof.

It is an object of this invention, with the aforenoted problem in mind, to set forth a stabilizer set which can accommodate for roof plate loading and offer a yieldability even where the basic, first stabilizer of the set has been radially and axially deformed. It is also an object of this invention to teach a method of stabilizing an earth structure or reinforcing such structure by inserting a second, supplementary stabilizer in a primary or first, bore-installed stabilizer, or by inserting a second, supplementary stabilizer into a primary or first stabilizer, and then inserting the two, joined stabilizers into an earth bore.

It is particularly an object of this invention to set forth a method of stabilizing an earth structure from within a bore formed in the structure, comprising the steps of inserting into the bore a friction rock stabilizer which has an elongate, substantially hollow body having inner and outer surfaces; and fastening a plate having a cut-out formed therein, against the earth structure in substantially surrounding relationship to the bore; wherein said plate-fastening step comprises engaging said plate with an elongate, substantially hollow, radially contractible element; and inserting said element into said body into fast, frictional engagement with said inner surface, along a substantial length of said element, and from one end of said stabilizer to an intermediate location along the length thereof.

It is another object of this invention to set forth a method of reinforcing an earth structure which has been stabilized by an elongate, substantially hollow, friction rock stabilizer inserted into a bore in the structure, comprising the step of inserting an elongate, substantially hollow, radially contractible element into the stabilizer, into fast, frictional engagement of said element with the stabilizer, along a substantial length of said element, and from one end of said stabilizer to an intermediate location along the length thereof.

Finally, it is an object of this invention to disclose a friction rock stabilizer set, as aforesaid, for stabilizing an earth structure from within a bore formed in the structure, comprising a first, elongate, substantially hollow, and radially contractible stabilizer; said first stabilizer having a body of given, relaxed, inside and outside diameters, and which is contractible to another, constrained, inside diameter; and a second, elongate, substantially hollow, and radially contractible stabilizer, for insertion into, and for frictional engagement with, said first stabilizer along a substantial length of said second stabilizer; wherein said second stabilizer has a body of a relaxed, outside diameter of a dimension taken from a range of diameters encompassed by said given, relaxed, outside diameter of said first stabilizer, and said another, constrained, inside diameter of said first diameter.

Figure 3:
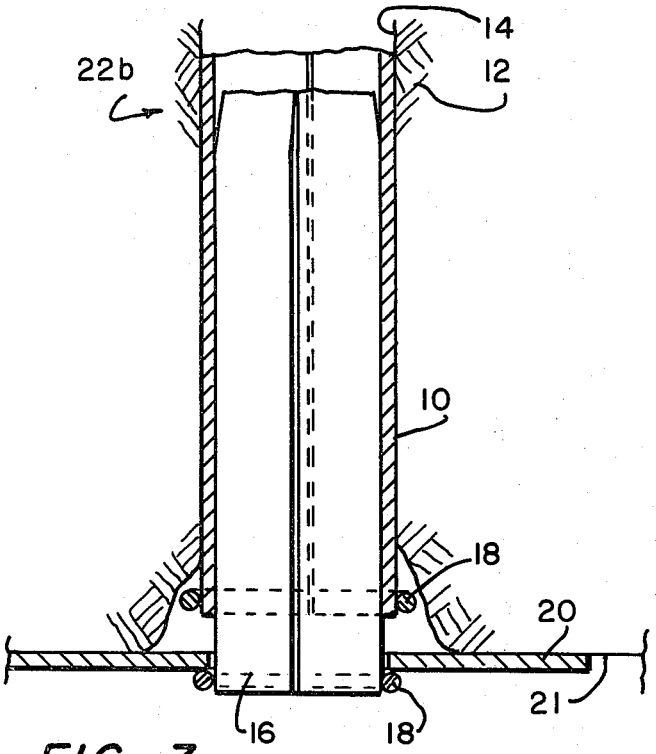
Figure 2:
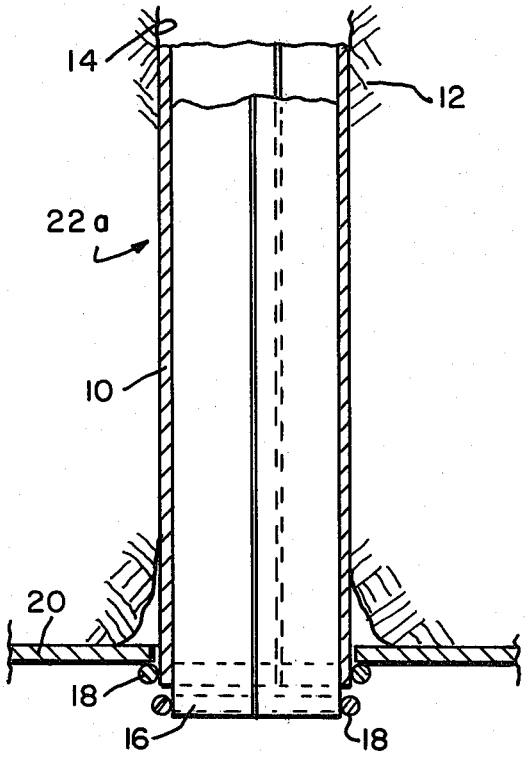
Figure 4:
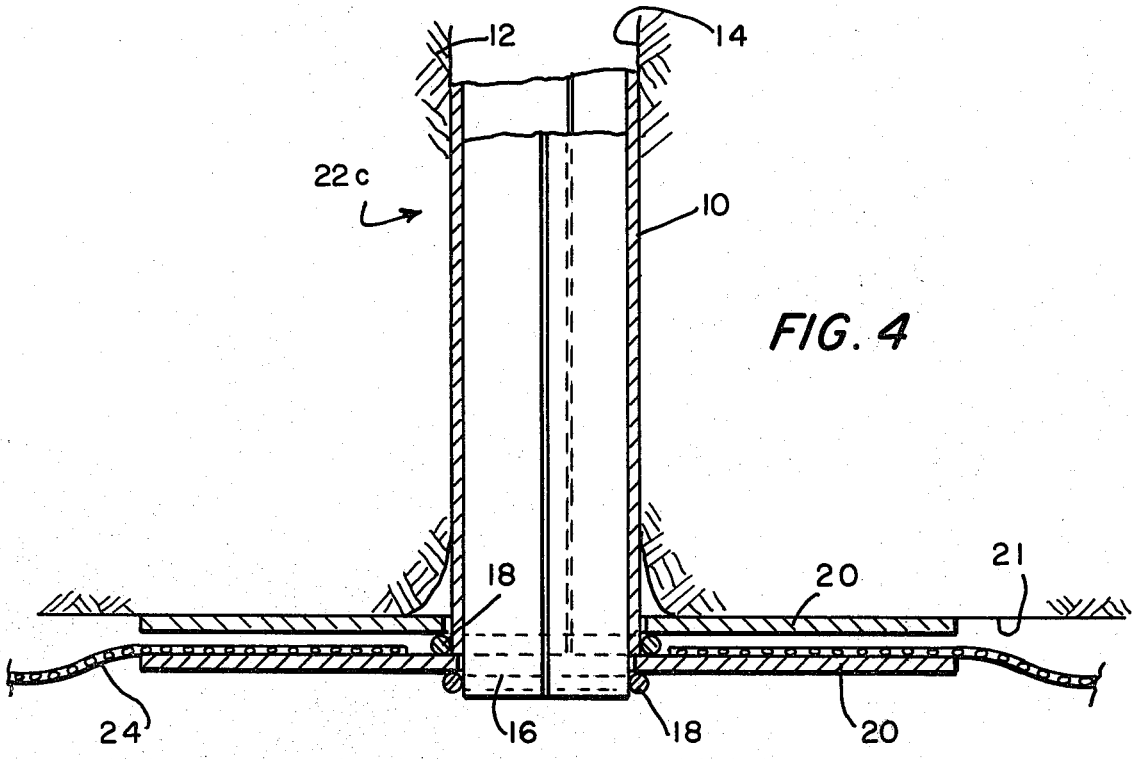

Further objects of this invention, as well as the novel features thereof, will become more apparent by reference to the following description taken in conjunction with the accompanying figures in which:

FIG. 1 is an elevational, cross-sectional view of an embodiment of a friction rock stabilizer set according to the invention; and FIGS. 2 through 4 are views similar to that of FIG. 1 showing alternative embodiments of the invention.

As shown in FIG. 1, a first, elongate, substantially hollow, and radially expandable friction rock stabilizer 10 is installed in an earth structure 12 within a bore 14 formed therein for the purposes of stabilizing the structure. The first or basic stabilizer 10 has no reinforcing ring or annulus. Instead, a second, shorter, and, in this embodiment thereof, a smaller diameter friction rock stabilizer 16 is slidably and frictionally engaged with the first. The second stabilizer 16, likewise, is a radially contractible and expandable element; both stabilizers 10 and 16, like that disclosed in U.S. Pat. No. Re. 30,256, and as depicted herein, have a slot extending lengthwise thereof to accommodate contraction and expansion. Second stabilizer 16 has been inserted into the lower end of the first stabilizer 10 and extends from the lower end of the first stabilizer 10 to an intermediate location along the length thereof. (As depicted, it is not fully inserted into the first stabilizer 10). The second, shorter stabilizer 16 has fixed thereto a reinforcing ring 18 which is known from U.S. Pat. No. 4,126,004, issued to Herman Lindeboom, on Nov. 21, 1978, for a "Friction Rock Stabilizer". The ring 18 reinforces the driven end of the shorter stabilizer 16 so that it can accommodate insertion force, and the ring 18 also provides a bearing surface for a roof plate 20. Upon the second stabilizer 16 being fully inserted into the first stabilizer 10, the plate 20 will be held fast against the earth structure face 21.

At mine sites, where the reinforcing ring 18 has broken away and come free from the basic stabilizer 10 and/or the roof plates 20 have fallen therefrom, it is only necessary to reinforce the first stabilizer 10 by inserting the second, shorter one 16 with its ring 18 and a new (or retrieved) plate 20. In FIG. 1, a missing, broken-away ring is represented by the phantom outline thereof and the index number 18*a*.

In some mine situations, the earth structure is somewhat incompetent, and a first stabilizer 10 inserted into a bore 14 will enter too freely so that it is not sufficiently frictionally engaging the wall of the bore 14 to stabilize the structure 12. Again, in these circumstances, it is necessary only to insert the shorter stabilizer 16, which may be of any length, perhaps substantially the length of the first stabilizer 10, to lend to the first stabilizer supplementary constraining force against the wall of the bore 14.

The stabilizer set 22, comprising the first stabilizer 10 and the mating, second stabilizer 16, in a first embodiment thereof is as shown in FIG. 1. Thus, the second stabilizer 16 has the reinforcing ring 18, and it supports the roof plate 20. In an alternative embodiment, as shown in FIG. 2, the first stabilizer 10 has a ring 18 (as described in the aforesaid Lindeboom patent) and it supports the roof plate 20; the second stabilizer 16 simply supplements the holding or stabilizing force of the first stabilizer 10. In this alternative embodiment, the second stabilizer 16 is inserted through the ring-end of stabilizer 10 and the plate 20. Further, in this alternative embodiment, the second stabilizer 16 also has a ring 18—to reinforce its driven end.

In another alternative embodiment, shown in FIG. 3, both stabilizers 10 and 16 have rings 18. The first stabilizer 10 is installed without a roof plate; the second stabilizer 16, however, carries the roof plate 20. This practice of the invention is used to anticipate the problem noted in connection with FIG. 1, i.e., where the ground conditions are such that there is a likelihood of the first stabilizer 10 losing its ring 18—if the latter were to support the plate 20. Stabilizer 16, in FIG. 3, can manifest a controlled yieldability, and withdrawn from the first stabilizer 10 with which it is engaged, to accommodate for inordinate loading of the plate 20.

Yet a further alternative embodiment is shown in FIG. 4 where both stabilizers 10 and 16 have rings 18 and both support plates 20. The first stabilizer 10 provides the basic earth stabilization, and the second stabilizer 16, and its plate 20, are used for supporting steel mesh 24, or brattice cloth, or the like.

Typical lengths for the supplemental, second stabilizers 16 will comprise one and a half to three feet, although they may be of lengths comparable to the first stabilizers 10. The latter are of various lengths: from two feet to ten feet. Typically, the stabilizers 10 have free, relaxed inside and outside diameters of given dimensions, and they are contractible to another, constrained, inside diameter—in order that they can be forced into bores 14 which are undersized for the relaxed dimensions or outside diameters thereof. The second, supplementary stabilizers 16 have a relaxed outside diameter of a dimension taken from a range of diameters encompassed by the aforesaid given, relaxed, outside diameter of the first stabilizer, and the constrained inside diameter of the first stabilizer.

In the practices and uses of the invention, of course, individual stabilizers 10 and 16, with or without rings 18 as the circumstances warrant, and plates 20 may be stocked. From the stocks, then, those components needed for the nature of the work at hand may be selected and employed. Also, however, the applications of the invention warrant the provisioning or stocking of stabilizer sets which are pre-packaged to meet the differing requirements.

Stabilizer set 22, of FIG. 1, will meet a need where the first stabilizer 10 is too freely received in the bore 14, and requires the supplementary, second stabilizer 16 to expand the first stabilizer 10 into adequate frictional engagement with the bore 14.

Stabilizer set 22*a*, of FIG. 3, is similar to set 22; it is used where a second stabilizer 16 is warranted to sufficiently expand the first stabilizer 10. Also, it is prescribed in those circumstances wherein there is a possibility of the loading of plate 20 displacing the ring 18 (from the first stabilizer).

Stabilizer set 22*b*, of FIG. 3, is recommended when heavy loading of the plate 20 calls for a controlled yieldability. In this, as priorly described, the second stabilizer 16 may "give" axially, and support the plate 20 (and the roof or wall) in an axially-displaced positioning.

Stabilizer set 22*c*, of FIG. 4, comprehends a "package" in which the first stabilizer 10 is the principal means of of earth anchorage, and the second stabilizer 16 is primarily for support of ancillary articles (such as mesh 24). Even so, it reinforces stabilizer 10, and provides a back-up for the ring 18 of stabilizer 10, and the plate 20 (held by stabilizer 10).

The stabilizer sets 22 (FIG. 1) and 22*a* through 22*c* (FIGS. 2–4) may, depending upon the subterranean conditions and/or the wishes of the users thereof, be inserted into the bores 14 together or separately. That is, the stabilizer 10 may be inserted into the bores 14, independently, and the second stabilizers 16 inserted into the first stabilizers 10 thereafter; alternatively, the two stabilizers 10 and 16—with the plates 20, or with the plates and the mesh 24—may be assembled out of the bore 14 and then be jointly fixed in the bore.

While I have described my invention in connection with specific embodiments thereof, it is to be clearly understood that this is done only by way of example and not as a limitation to the scope of my invention as set forth in the objects thereof and in the appended claims. For instance, for exemplary purposes, I show pairs of stabilizers 10 and 16 as comprising the sets 22, 22*a* through 22*c*. The invention comprehends sets of more than two stabilizers, as circumstances may warrant. Also, the stabilizers 10 and 16 in the sets are shown as having axially-extended slots—the edges of which interface. In alternative embodiments, one or both of the stabilizers 10 and 16 may have axially-extended, overlapping edges, according to the teaching in my U.S. Pat. No. 4,012,913, issued on Mar. 22, 1977, for "Friction Rock Stabilizers." Accordingly, these, and other alternative embodiments, as will occur to others from my teachings herein, are deemed to be within the ambit of my invention and comprised by the following claims.

I claim:

1. A method of stabilizing an earth structure from within a bore formed in the structure, comprising the steps of:

inserting into the bore a radially contractible and expandable friction rock stabilizer which has an elongate, substantially hollow body having inner and outer surfaces; and fastening a plate, having a cut-out formed therein, against the earth structure in substantially surrounding relationship to the bore; wherein said plate-fastening step comprises engaging said plate by penetrating the cut-out formed therein with an elongate, substantially hollow, radially contractible and expandable element which has an externally-projecting bearing surface; and inserting said element into said body into fast, frictional engagement with said inner surface, along a substantial length of said element, and from one end of said stabilizer to an intermediate location along the length thereof until said bearing surface closes into contacting engagement with the plate to fasten the plate against the earth structure.

2. A method of stabilizing an earth structure from within a bore formed in the structure, according to claim 1, wherein:

said element-inserting step comprises inserting into said body an element having a cross-sectional dimension relative to the cross-sectional dimension of the hollow body which causes radial contraction of said element upon insertion of the latter into said body.

3. A method of reinforcing an earth structure which has been stabilized by an elongate, substantially hollow, radially contractible and expandable friction rock stabilizer inserted into a bore in the structure, comprising the step of:

inserting an elongate, substantially hollow, radially contractible and expandable element into the stabilizer, into fast, frictional engagement of said element with the stabilizer, along the substantial length of said element, and from one end of said stabilizer into an intermediate location along the length thereof.

4. A method or stabilizing an earth structure from within a bore formed in the structure, comprising the steps of:

inserting into the bore a radially contractible and expandable friction rock stabilizer which has (a) an elongate, substantially hollow body having inner and outer surfaces, and (b) an elongate, substantially hollow, radially contractible and expandable element which has been coaxially joined with said body, and is in fast, frictional engagement with said inner surface of said stabilizer.

5. A method of stabilizing an earth structure, according to claim 4, further including the step of:

fixing a given plate, having a cut-out formed therein, against the earth structure and circumjacent said element.

6. A method of stabilizing an earth structure, according to claim 5, wherein:

said plate-fixing step comprises forming an outwardly-extending prominence on said stabilizer, and passing said stabilizer through said cut-out until said plate engages said prominence, prior to inserting said stabilizer into the bore.

7. A method of stabilizing an earth structure, according to claim 6, further including the step of:

coupling another plate, having a cut-out formed therein, to said element in spaced-apart, substantially parallel relationship to said given plate; wherein said coupling step comprises forming an outwardly-extending prominence on said element, and passing said element through said cut-out until said another plate engages said prominence on said element, prior to coaxially joining said element with said body in frictional engagement with said inner surface thereof.

8. A method of stabilizing an earth structure, according to claim 5, wherein:

said plate-fixing step comprises forming an outwardly-extending prominence on said element, and passing said element through said cut-out until said plate engages said prominence, prior to coaxially joining said element with said body in frictional engagement with said inner surface thereof.

9. A method of stabilizing an earth structure from within a bore formed in the structure, comprising the steps of:

inserting into the bore a radially contractible and expandable friction rock stabilizer which has an elongate, substantially hollow body having inner and outer surfaces; and inserting an elongate, substantially hollow, radially contractible and expandable element into said body into fast, frictional engagement with said inner surface, along a substantial length of said element, and from one end of said stabilizer to an intermediate location along the length thereof.

10. A friction rock stabilizer set, for stabilizing an earth structure from within a bore formed in the structure, comprising:

a first, elongate, substantially hollow, and radially contractible and expandable stabilizer;

said first stabilizer having a body of given, relaxed, inside and outside diameters, and which is contractible to another, constrained, inside diameter; and a second, elongate, substantially hollow, and radially contractible and expandable stabilizer coaxially joined to, and in fast, frictional engagement with, said first stabilizer along a substantial length of said second stabilizer; wherein said second stabilizer has a body of a relaxed, outside diameter of a dimension taken from a range of diameters encompassed by said given, relaxed, outside diameter of said first stabilizer, and said constrained, inside diameter of said first stabilizer.

11. A friction rock stabilizer set, according to claim 10, wherein:

at least one of said first and second stabilizers has an annulus, integral therewith, immediately adjacent an end thereof.

12. A friction rock stabilizer set, according to claim 11, further including:

a plate circumjacent, and coupled to, one of said stabilizers.

13. A friction rock stabilizer set, according to claim 11, further including:

a plate, circumjacent both of said stabilizers, coupled to one of said stabilizers.

14. A friction rock stabilizer set, according to claim 11, further including:

a pair of plates; wherein one of each of said plates is circumjacent, and coupled to, one of said stabilizers.

15. A friction rock stabilizer set, according to claim 10, wherein:

each of said stabilizers has an annulus, integral therewith, immediately adjacent an end thereof.

* * * * *